US005461409A

United States Patent [19]

Kim

[11] Patent Number: 5,461,409

[45] Date of Patent: Oct. 24, 1995

[54] THERMAL TRANSFER PRINTER HAVING A RECORDING MEDIUM CLAMPING DEVICE

[75] Inventor: Wan-ha Kim, Suwon, Rep. of Korea

[73] Assignee: Samsung Electronics Co., Ltd., Kyungki-do, Rep. of Korea

[21] Appl. No.: 980,697

[22] Filed: Nov. 24, 1992

[30] Foreign Application Priority Data

Feb. 29, 1992 [KR] Rep. of Korea ..... 92-3331

[51] Int. Cl.[6] ..... B41J 2/325

[52] U.S. Cl. ..... 347/218; 347/176

[58] Field of Search ..... 346/76 PH, 134, 346/136; 400/120, 120.04; 271/275, 277; 347/208, 172, 174, 176

[56] References Cited

U.S. PATENT DOCUMENTS

| | | | |
|---|---|---|---|
| 4,829,320 | 5/1989 | Une et al. | 346/76 PH |
| 4,985,711 | 1/1991 | Nakamura et al. | 346/76 PH |
| 5,124,724 | 6/1992 | Hatakeyama et al. | 346/76 PH |

FOREIGN PATENT DOCUMENTS

| | | | |
|---|---|---|---|
| 0199667 | 8/1988 | Japan | 346/76 PH |

*Primary Examiner*—Huan H. Tran

*Attorney, Agent, or Firm*—Sughrue, Mion, Zinn, Macpeak & Seas

[57] ABSTRACT

A thermal transfer printer which has a drum around which paper is conveyed and a thermal transfer head for heat-pressing an ink ribbon on a paper sheet to print pictures and characters. The printer includes a roller movably installed and spaced from the drum by a predetermined distance, a belt circumscribing the drum and roller for conveying the paper sheet, clamps installed on either side of the belt for clamping the end of the paper sheet to the belt and having flanges with through holes on one end of the clamps, and a clamping release mechanism for releasing the clamping action of the clamps. In the method, the paper sheet is conveyed in a first direction and at a first speed for successively printing different colors and conveyed in a second opposite direction at a second speed faster than the first speed to prepare for printing of the next color. As a result, printing time is minimized.

9 Claims, 4 Drawing Sheets

THERMAL TRANSFER PRINTER HAVING A RECORDING MEDIUM CLAMPING DEVICE

BACKGROUND OF THE INVENTION

1. Field of the Invention

The present invention relates to a thermal transfer printer and method for printing pictures and characters, and more particularly to a thermal transfer printer which precisely conveys paper, reduces printing time, size and weight of the apparatus, and is suitable for video color printers and color facsimiles.

2. Background

In a conventional thermal transfer printer, there are four different designs for conveying paper as respectively illustrated in FIGS. 1A, 1B, 1C and 1D.

FIG. 1A illustrates a conventional design using a platen wherein printing is accomplished by conveying a paper sheet 3 at a constant speed due to the frictional engagement of the paper on drum 1 resulting from the application of pressure by thermal print head 2. This design is, however, disadvantageous because, during the conveying, the paper tends to slip as thermal transfer head 2 is unable to apply a sufficient pressure on the paper, thereby greatly distorting the three colors of yellow, magenta and cyan. It is noted that reference numeral 4 represents an ink ribbon and 5*a* represents guiding rollers.

FIG. 1B illustrates another conventional design using a drum. In order to overcome the problem of the platen design, a holder 6 for holding the end of paper sheet 3 is mounted on a drum 1. However, this design requires a large drum so as to enable to paper sheet 3 to be wound around drum 1 only a single revolution, resulting in a relatively heavy apparatus. In FIG. 1B, reference numeral 2 also represents a thermal transfer head and reference numeral 4 represents an ink ribbon.

In order to solve these problems, there have been proposed a capstan design and gripper design respectively illustrated in FIGS. 1C and 1D. In each of these designs, a drum 1 functions only to support paper sheet 3. In the capstan design the paper is conveyed by a capstan 7 and pinch roller 8 while in the gripper design the paper is conveyed by the reciprocating movement of a gripper 9. Reference numerals 5*b*, 5*c* and 5*d* denote guiding rollers. According to these designs, the paper must be reciprocated back and forth to successively print each color and therefore the printing time to print three colors of yellow, magenta and cyan is relatively long.

SUMMARY OF THE INVENTION

Therefore, it is an object of the present invention to provide a thermal transfer printer and method which precisely conveys papers, and reduces printing time as well as the size and weight of the apparatus.

To accomplish this object, there is provided a thermal transfer printer, comprising: a drum; a thermal transfer head for heat-pressing an ink ribbon on the paper sheet to print pictures and characters; a roller rotatably installed at a position spaced from the drum by a predetermined distance; a belt looped around the drum and the roller for conveying the paper sheet; clamps corresponding installed on either side of the belt for clamping the end of the paper sheet and having flanges with through holes on one end of the clamps; and a clamping release mechanism for releasing the clamping action of the clamps.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Figure 1A:
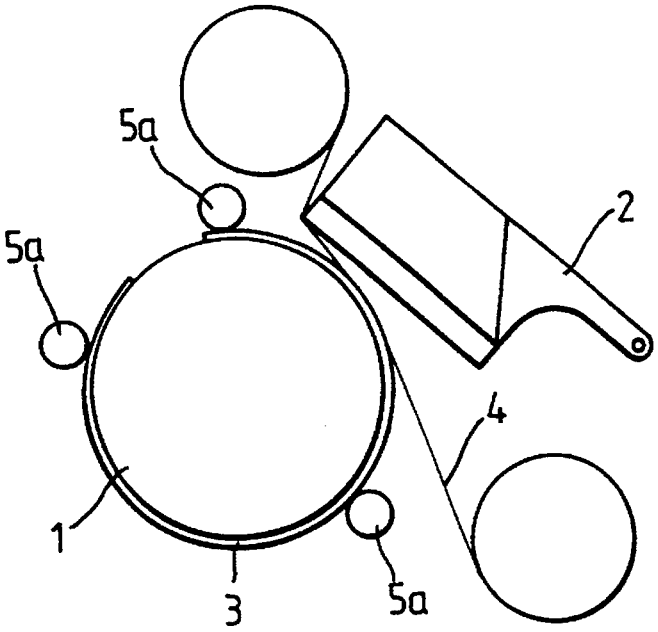
FIG. 1A (PRIOR ART)
FIGS. 1A to 1D schematically illustrate conventional thermal transfer printers.
Figure 1B:
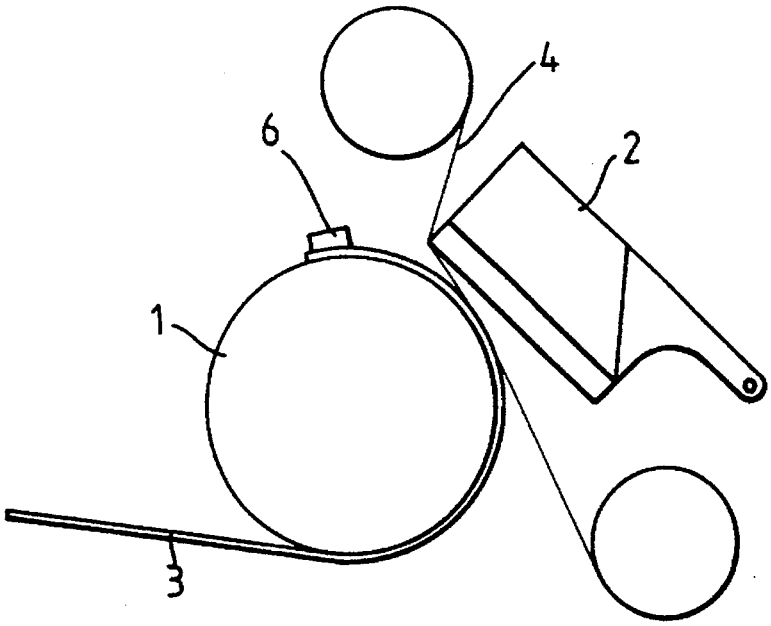
FIG. 1B (PRIOR ART)
Figure 1C:
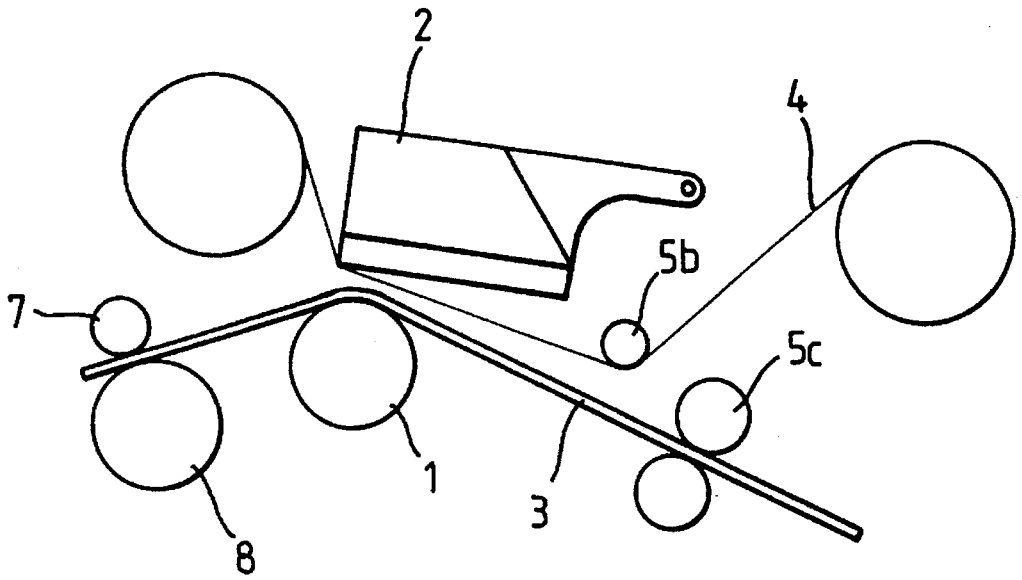
FIG. 1C (PRIOR ART)
Figure 1D:
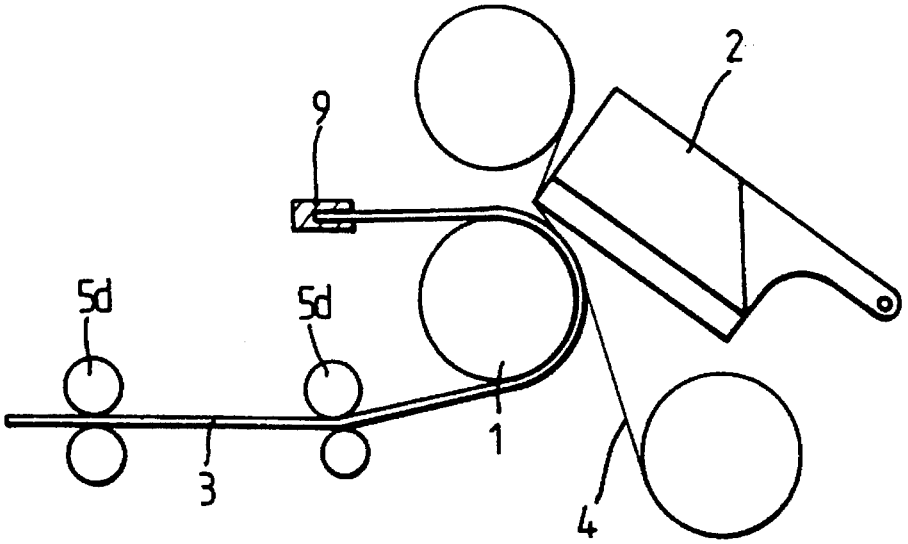
FIG. 1D (PRIOR ART)
Figure 2:
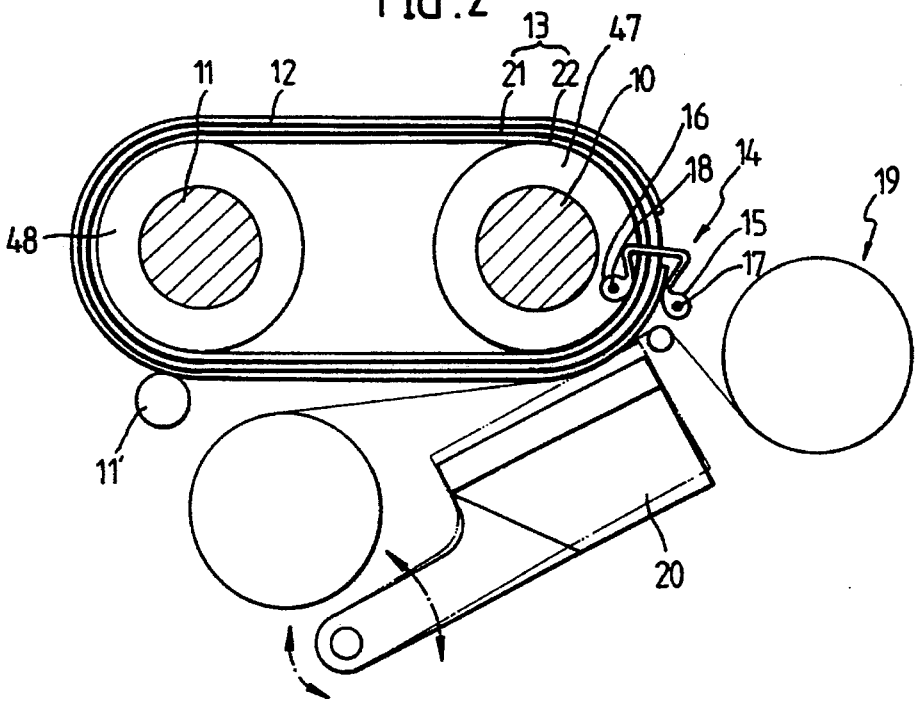
FIG. 2 is a schematical side view of a thermal transfer printer according to the present invention.
Figure 3:
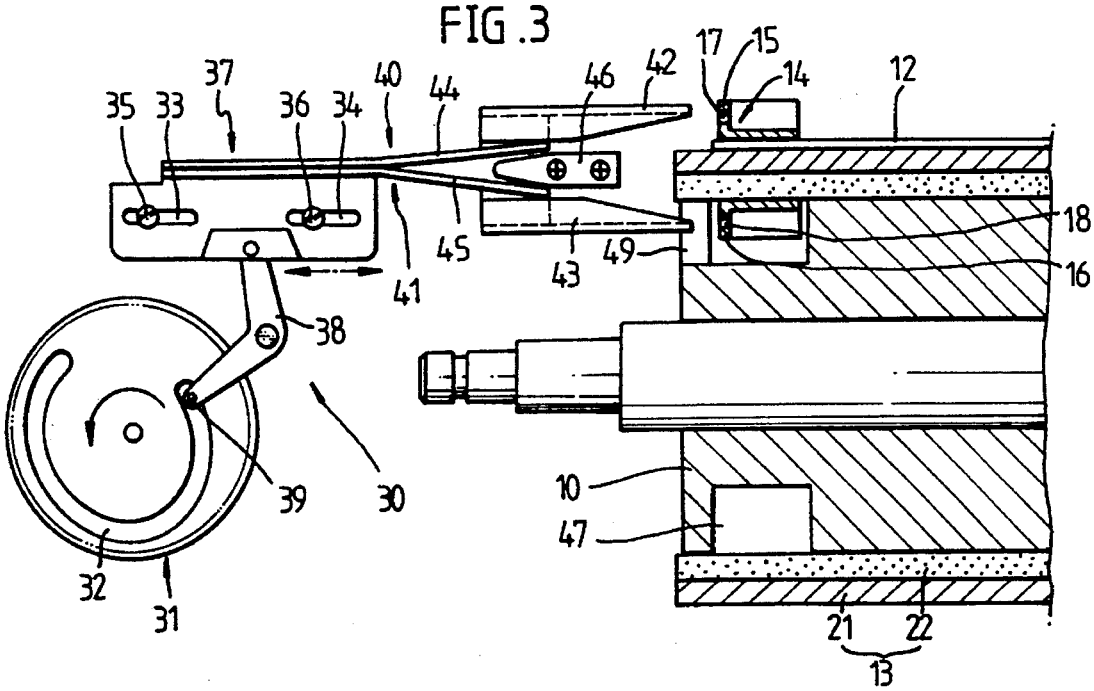
FIG. 3 is a schematical side view of a clamping release mechanism of a thermal transfer printer according to the present invention.
Figure 4:
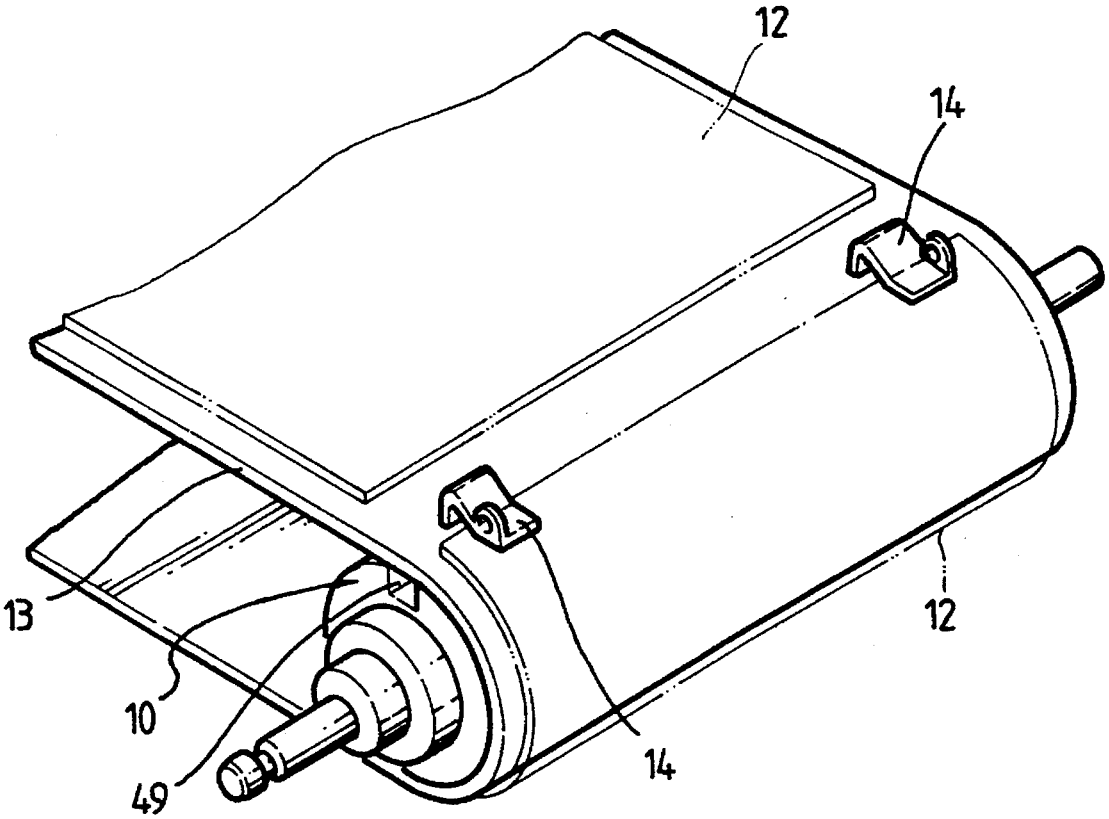
FIG. 4 is a perspective view illustrating the installation state of a clamp of the present invention.

Referring to FIGS. 2–4, a drum 10 and roller 11 are spaced apart from each other by a predetermined distance, and a belt 13 for conveying a paper sheet 12 is circumscribed therearound. Clamps 14 for clamping the end of paper sheet 12 are correspondingly installed on opposite lateral sides of belt 13. Each clamp 14 has flanges 15 and 16 with through holes 17 and 18, respectively. A clamping release mechanism 30 for releasing the clamping force of clamp 14 is provided on either side of drum 10. Thermal transfer head 20 opposes drum 10 for heat-pressing an ink ribbon 19 onto the clamped paper sheet 12 so as to form a picture and characters thereon.

In more detail, the belt 13 is made of a layer of acrylonitrile-butadiene rubber 21 having an excellent wearproof property and a large coefficient of friction and silicon rubber 22 having high heat resistance. It is desirable that a ceramic coating layer be formed on drum 10 so as to enhance the friction thereof.

The clamping release mechanism 30 includes a rotating cam 31 having a cam slot 32, a slider 37 and a pivotably disposed cam lever 38. A pin 39 is provided at one end of the cam lever 38 and is slidably disposed in the cam slot 32. The opposite end of the cam lever is pivotably connected to slider 37, as illustrated in FIG. 3. The slider has a pair of guiding slots and guide pins 35 and 36 so as to be moveable in a rectilinear manner as illustrated by the arrow in FIG. 3. A pair of resilient supports 40 and 41, adhered to each other at one end, are fixed to slider 37 so as to move therewith. The opposite ends of the supports 40 and 41 are bent at a specific angle in opposite directions so as to include bent portions 44 and 45. Release arms 42 and 43 are respectively secured to bent portions 44 and 45 and are insertable into through holes 17 and 18 formed in flanges 15 and 16 of clamp 14. A wedge-shaped widening device 46 is installed between the bent portions 44 and 45 of resilient supports 40 and 41 for urging the bent portions 44 and 45 of resilient supports 40 and 41 in opposite directions during the movement of slider 37. A space 47 is provided in drum 10 so as to prevent flanges 15 and 16 of clamp 14 from contacting the drum 10 during its rotation. Additionally, a release mechanism insertion groove 49 is provided in the drum 10 for allowing insertion of the release arms 42 and 43, as illustrated in FIG. 3.

The operation of the thermal transfer printer having such a structure as above will be described below.

First, when paper sheet 12 is supplied, it is conveyed along the belt 13 by paper guiding roller 11 and is stopped near clamp 14 installed on belt 13. The clamp 14 clamps the end of paper sheet 12 by actuation the clamping release mechanism 30 associated with clamp 14. Specifically, rotating cam 31 is rotated counter-clockwise as shown in FIG. 3 causing slider 37, hinged to one end of cam lever 38, to move forwardly as the slider is guided by guide slots 33 and 34 and guide pins 35 and 36. Release arms 42 and 43 respectively engage the through holes 17 and 18 formed on flanges 15 and 16 of clamp 14. Under this condition, when slider 37 continues to move forwardly, the bent portions 44 and 45 of resilient supports 40 and 41 are forced in opposite directions by wedge-shaped widening device 46 so that flanges 15 and 16 of clamp 14 are urged apart by release arms 42 and 43. Thereafter, the paper is further advanced until it is positioned between flange 15 and the belt 13 whereupon the clamping release mechanism 30 operates in reverse so that clamp 14 clamps the end of paper sheet 12. After the sheet has been clamped, thermal transfer head 20 is rotated counter-clockwise so as to heat-press the ink ribbon 19 against paper sheet 12, and simultaneously, drum 10 is rotated counter-clockwise so that belt 13 is attendantly rotated counter-clockwise due to the frictional engagement with the drum 10. As a result, paper sheet 12 is conveyed at a predetermined speed allowing a single color such as yellow to be printed on the sheet. Thereafter, thermal transfer head 20 is rotated clockwise to return to the initial position and drum 10 is rotated in reverse at an increased speed, up to the initial printing position for the subsequent printing of the color magenta. According to the method of the present invention, magenta and cyan are sequentially printed on paper sheet 12. It is noted that movement of clamp 14, installed on belt 13, is not interfered with by drum 10 during rotation due to the presence of hole 47 provided on either side of drum 10. Moreover, since the paper sheet is firmly clamped by clamp 14 as described above and conveyed by belt 13 made of acrylonitrile-butadiene rubber 21 having excellent wearproof and frictional properties, the precise conveyance of paper is accomplished.

Further, since roller 11 is installed so as to be spaced from drum 10 by a specific distance and paper sheet 12 is conveyed by belt 13 which circumscribes drum 10 and roller 11, the size and weight of the apparatus can be sharply reduced. Moreover, since after each of the colors of yellow, magenta and cyan are printed the paper is returned to the initial printing position by conveying the belt in reverse at an increased speed, the printing time can be shortened. After the printing of all three colors has been completed, release arms 42 and 43 of clamping release mechanism 30 are activated to widen the clamp 14 so as to attendantly release the clamping of the paper sheet 12. As a result, the paper sheet 12 is separated from belt 13 due to its own weight and discharged by a paper discharge device (not shown).

As described above, the size and weight of the thermal transfer printer of the present invention are significantly reduced as compared to the convention printers since paper is conveyed by a belt circumscribing a rum and roller. Further, precise conveyance of the paper is accomplished since the paper sheets are conveyed by a belt made of acrylonitrile-butadiene rubber having excellent wearproof and frictional properties and a clamp installed on the belt clamps the forward end of the sheets. Furthermore, the printing time can be reduced since the three colors of yellow, magenta and cyan are printed while a paper sheet is rotated in a reverse direction at an increased speed.

What is claimed is:

1. A thermal transfer printer for transferring ink from an ink ribbon to a paper sheet, comprising:

a rotatably supported drum;

an endless belt circumscribing said drum and being conveyed upon rotation of said drum so as to convey said paper sheet at least partially around said drum;

a thermal print head for heat-pressing said ink ribbon against said paper sheet;

a pair of clamps respectively disposed on opposite lateral sides of said belt for clamping an end of said paper sheet to said belt, each of said clamps includes first and second flanges which oppose one another, said first flange being urged against an internal surface of said belt and said second flange being urged against an external surface of said belt to enable said sheet to be retained between said second flange and said external surface of said belt; and clamping release means for disengaging said clamps from said sheet to allow said sheet to be removed from said belt.

2. The printer of claim 1, further comprising a rotatably supported roller spaced a predetermined distance from said drum and being arranged parallel thereto, said belt circumscribing said drum and said roller.

3. The printer of claim 1, wherein said clamping release means comprises:

a slider including first and second support arms extending therefrom;

moving means for moving said slider in an unclamping direction to enable said first and second support arms to respectively engage said first and second flanges of each of said clamps; and forcing means for forcing said support arms in opposite directions so as to attendantly deflect said flanges in opposite directions and urge said second flange away from said external surface of said belt allowing said sheet to be inserted therebetween or removed therefrom.

4. The printer of claim 3, wherein said moving means comprises:

a rotatable cam having a cam slot; and a pivotally disposed cam lever having a cam pin at one end thereof received in said cam slot and being pivotally attached to said slider at the opposite end of said lever, wherein rotation of said cam causes said lever to pivot and, attendantly, said slider to move in said unclamping direction.

5. The printer of claim 3, wherein said forcing means comprises:

a wedge-shaped widening device installed between said support arms, wherein movement of said slider in said unclamping direction causes said widening device to urge said support arms in said opposite directions.

6. The printer of claim 3, wherein each of said support arms includes a bent portion such that distal ends thereof are angled in said opposite directions to facilitate engagement with said flanges.

7. The printer of claim 6, wherein each of said flanges has a hole for receiving said distal end of said support arms.

8. The printer of claim 1, wherein said belt includes an acrylonitrile-butadiene rubber layer of a specific coefficient of friction disposed on a silicon rubber layer of a predetermined heat resistance.

9. A method of priming comprising the following steps:

(a) supplying a paper sheet to a conveying belt supported on a drum;

(b) positioning a multicolor ink ribbon adjacent a portion of said paper sheet, said ink ribbon having different color ink regions sequentially arranged along the length thereof;

(c) pressing a thermal transfer primer head against said portion of said paper sheet with said ink ribbon disposed therebetween;

(d) rotating said drum so as to convey said paper sheet in a first direction and at a first speed while printing a single color from said ink ribbon to said paper sheet;

(e) feeding said ink ribbon to position a next one of said different color ink regions in opposition to said paper sheet;

(f) rotating said drum in an opposite direction so as to attendantly convey said paper sheet in a second direction opposite said first direction and at a second speed which is faster than said first speed; and (g) successively repeating steps (d), (e), and (f) for each color to be printed.

* * * * *